United States Patent [19]

Klappert

[11] 4,024,486

[45] May 17, 1977

[54] OUTER LOCKING TURN FOR PRECUT CORE

[75] Inventor: Willi Klappert, Hickory, N.C.

[73] Assignee: General Electric Company, N.Y.

[22] Filed: July 14, 1975

[21] Appl. No.: 595,592

[52] U.S. Cl. ..... 336/210; 336/211

[51] Int. Cl.[2] ..... H01F 27/26

[58] Field of Search ..... 24/20 TT, 20 EE, 20 R, 24/17 A; 336/210, 211, 216, 217; 310/217, 218

[56] References Cited

UNITED STATES PATENTS

| | | | |
|---|---|---|---|
| 100,897 | 3/1870 | Hunt | 24/20 EE X |
| 1,645,963 | 10/1927 | Moore | 24/20 TT |
| 2,148,449 | 2/1939 | Edwards | 336/210 X |
| 2,218,717 | 10/1940 | McKee | 24/17 A X |
| 3,186,067 | 6/1965 | Somerville | 336/211 UX |
| 3,324,234 | 6/1967 | Herrig | 24/20 R |
| 3,422,570 | 1/1969 | Vorst et al. | 24/20 TT |
| 3,812,554 | 5/1974 | Klappent | 336/211 X |

FOREIGN PATENTS OR APPLICATIONS

| | | | |
|---|---|---|---|
| 583,251 | 1/1925 | France | 336/210 |

*Primary Examiner*—Thomas J. Kozma
*Attorney, Agent, or Firm*—Francis X. Doyle

[57] ABSTRACT

A precut nested magnetic core having a locking outer turn. The locking turn is formed of magnetic core steel and has a pair of locking slots in one end and a single locking tab in the opposite end. The precut annular core is locked by using the second or inner slot with the locking tab while the formed annealed core is locked by using the first or outer slot with the locking tab.

1 Claim, 5 Drawing Figures

OUTER LOCKING TURN FOR PRECUT CORE

BACKGROUND OF THE INVENTION

This invention relates to magnetic induction cores and more particularly, to the provision of a lock for the outer turn of such core to enable locking with such locking outer turn.

In the magnetic core art for use in magnetic induction apparatus, the core is formed of a plurality of laminations of magnetic strip material. Often the core material is wound about a mandrel in a circular form until the desired number of laminations are provided. Then the wound core is cut, for example, along a single radial line, to provide single turn laminations. The cut laminations are then re-assembled, shaped and annealed to form the desired core. See for example, U.S. Pat. No. 3,186,067. In this manufacturing process, usually the outer turn is banded or welded to the desired circumference and the other laminations are assembled within such outer turn. Such outer turn then being called a stacking ring.

Recently it has been found that the process of re-assembling the cut core be readily performed by nesting by starting with the inner turn and progressing to the outer turn. After the core has been re-assembled in the annular shape, the precut core must be locked during the forming and annealing operation. Also, after lacing the precut formed core with a preform coil, it is desirable to provide a locking outer turn to aid in holding the core together during operation of the electrical induction apparatus utilizing the core and coil. This invention provides a novel, locking outer turn that may be used for locking during forming and annealing and also used for locking the laced core after it has been laced with a preformed coil.

It is therefore a principal object of this invention to provide a simple, easily locked outer locking turn for a precut core.

It is a further object of this invention to provide a locking outer turn for a precut core which may be reused to lock the precut core when laced with a preformed coil.

SUMMARY OF THE INVENTION

Briefly, in one form this invention provides an outer locking turn for a precut core comprising a strip of magnetic core steel having a locking tab at one end and a pair of locking slots at the other end. When a precut core is nested and formed, the outer locking turn is placed around the precut core and the locking tab locked in the second or inner locking slot. When laced with a preformed core, the outer locking turn is locked by placing the locking tab in the first or outer locking slot.

The invention which is sought to be protected will be particularly pointed out and distinctly claimed in the claims appended hereto. However, it is believed that this invention and the manner in which its various objects and advantages are obtained, as well as other objects and advantages thereof, will be more readily understood by reference to the following detailed description of a preferred embodiment thereof particularly when considered in the light of the accompanying drawings.

DESCRIPTION OF PREFERRED EMBODIMENT

Figure 1:
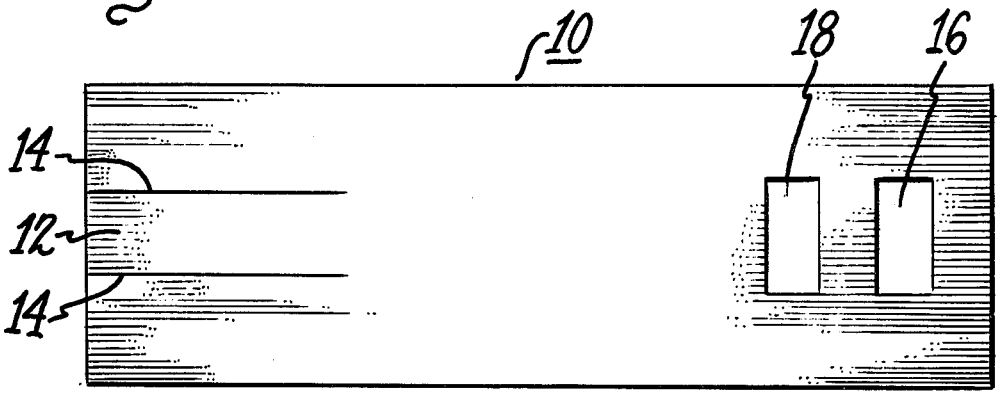
FIG. 1 is a plan view of the preferred embodiment of the outer locking turn of this invention.

This invention relates to precut induction cores of laminations of magnetic core steel and in particular to an outer locking turn for such precut cores. The locking turn of this invention is useful for both locking the precut core during the annealing and forming operation and also to lock the precut core when it is laced with a preformed coil. The preferred embodiment will be described by reference to the drawing, in which like numerals will be used to indicate like parts throughout the various views.

Figure 2:
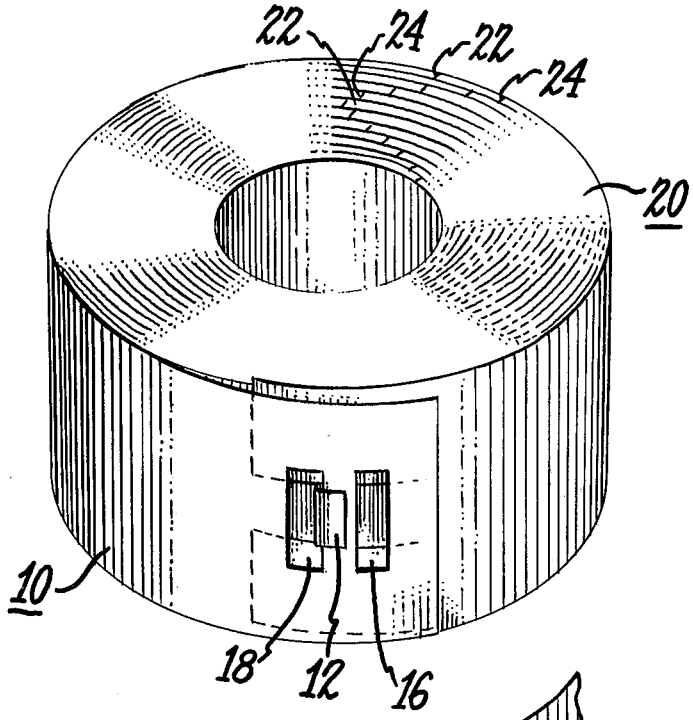
FIG. 2 is a perspective view of a precut magnetic core using the outer locking turn of this invention.
Figure 3:
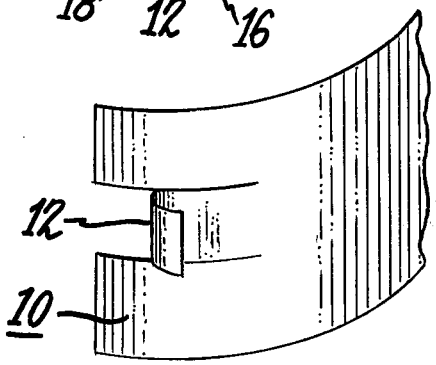
FIG. 3 is a perspective view of a portion of the locking turn of this invention showing one view of the locking tab.

Referring first to FIG. 1, there is shown a plan view of the preferred locking turn 10 of this invention. The locking turn 10 is formed from a strip of magnetic core steel having a locking tab 12 formed at one end by the slits 14. The opposite end of locking turn 10 is provided with a first or outer locking slot 16 and a second or inner locking slot 18. FIG. 2 shows the use of the locking turn 10 with a precut core 20, formed of a plurality of precut laminations 22. As can be seen from FIG. 2, each lamination 22 forms a butt joint 24 which is staggered with respect to each other, in a manner well understood by those skilled in the art. See for example, U.S. Pat. No. 3,186,067. In the preferred embodiment shown in FIG. 2, outer locking turn 10 is placed around the nested core 20 with the locking portion of the locking turn 10 locked about the core 20 on the side opposite the staggered butt joints 24, as shown. The locking tab 12 is placed through the inner or second locking slot 18, and bent over, as can best be seen in FIG. 3, to lock the outer turn 10 about the precut nested core 20.

Figure 4:
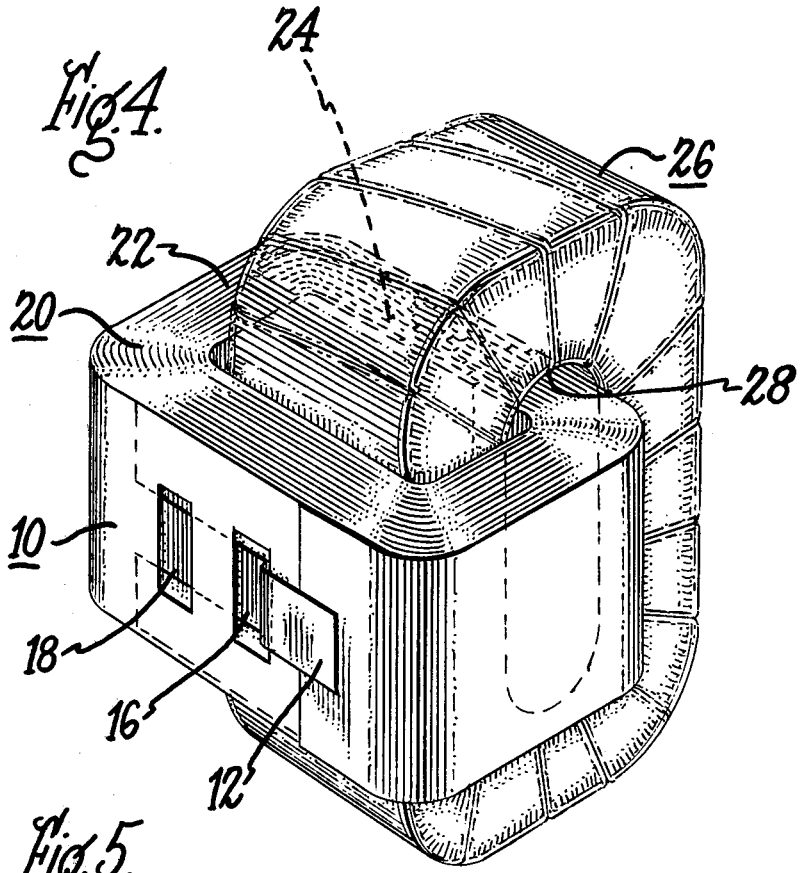
FIG. 4 is a perspective view of a formed precut core, laced with a preform coil, showing another view of the locking outer turn of this invention.
Figure 5:
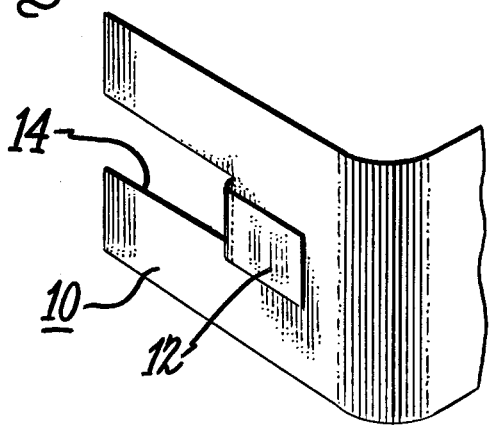
FIG. 5 is a perspective view of a portion of the locking tab of this invention showing a further view of the locking tab.

As will be understood, the precut, nested core 20, is formed and then annealed, for example, as taught in U.S. Pat. No. 3,186,067. After forming and annealing the core 20 is then assembled with a preformed coil in a well known manner. FIG. 4 shows the formed and annealed core 20 laced about the preformed coil 26. In this operation, the core 20 is laced about coil 26, either in single laminations or packets, depending upon the type of core 20 and the preformed coil 26. As laced, the butt joints 24 are preferably formed within the window 28 of the coil 26, as is shown in FIG. 4. After core 20 is laced about coil 26, the outer locking turn 10 is placed about the laced core 20 and locked by placing the locking tab 12 in the outer or first locking slot 16 as shown. FIG. 5 shows how locking tab 12 is bent inwardly almost to the end of slit 14. The use of two locking slots 16 and 18 is preferred to prevent breaking of the locking tab 12 when it is used a second time as in FIG. 4 to lock the outer locking ring 10 about the laced core 20.

While there has been shown and described the present preferred embodiment of this invention, it will be clear to those skilled in the art that changes may be made. For example, only a single locking slot, either 16 or 18 could be used if desired. However, it is preferred to use both locking slot 16 and 18 to prevent excess bending at a single point of the tab 12 which could cause breaking of tab 12. Thus, it will be understood that the foregoing description is for illustrative purposes only and that the invention set forth herein is limited only in the manner required by the appended claims.

What is new and which it is desired to secure by Letters Patent of the United States is:

1. An outer locking turn locking precut induction core of an electrical apparatus comprising;

a strip or magnetic core steel extending about the outside of a nested magnetic induction core, the ends of said strip overlapping, one end of said strip having a locking tab and the other end of said strip having a pair of locking slots, said locking tab engaging and locking with either of said locking slots, said locking turn being locked by engagement of said locking tab with one of said slots at a point displaced from a zone of stress having been created in said tab by the engagement of said tab with the other of said slots when said locking turn was locked about said nested magnetic core during the forming of said core prior to the lacing of said core with a coil.

* * * * *